US005893383A

United States Patent [19]

Facteau

[11] Patent Number: 5,893,383

[45] Date of Patent: Apr. 13, 1999

[54] FLUIDIC OSCILLATOR

[75] Inventor: David M. Facteau, Midland, Tex.

[73] Assignee: Perfclean International, Midland, Tex.

[21] Appl. No.: 08/977,960

[22] Filed: Nov. 25, 1997

[51] Int. Cl.[6] ..... F15C 1/08

[52] U.S. Cl. ..... 137/14; 137/810; 137/811; 137/826

[58] Field of Search ..... 137/810, 811, 137/825, 826, 808, 834, 14

[56] References Cited

U.S. PATENT DOCUMENTS

| | | | |
|---|---|---|---|
| 1,230,666 | 6/1917 | Carden . | |
| 1,333,390 | 3/1920 | Dickinson . | |
| 2,574,141 | 11/1951 | Brown | 166/18 |
| 2,661,065 | 12/1953 | McCoy | 166/18 |
| 4,041,984 | 8/1977 | Morel | 137/842 |
| 4,231,519 | 11/1980 | Bauer | 239/102 |
| 4,276,943 | 7/1981 | Holmes | 137/810 |
| 4,562,867 | 1/1986 | Stouffer | 137/811 |
| 4,854,176 | 8/1989 | Okabayashi | 137/826 |
| 5,035,361 | 7/1991 | Stouffer | 239/589.1 |
| 5,135,051 | 8/1992 | Facteau et al. | 166/104 |
| 5,165,438 | 11/1992 | Facteau et al. | 137/826 |
| 5,638,867 | 6/1997 | Huang | 137/826 |
| 5,769,164 | 6/1998 | Archer | 166/222 |
| 8,035,361 | 7/1991 | Stouffer | 137/826 |

FOREIGN PATENT DOCUMENTS 1343503 1/1974 United Kingdom .

*Primary Examiner*—A. Michael Chambers
*Attorney, Agent, or Firm*—Sidley & Austin

[57] ABSTRACT

A fluidic oscillator is disclosed for providing oscillating flow to outlet ports (172, 173). The fluid oscillator (100) in one embodiment has no fluid communication between a pair of diverging diffuser legs (163, 164) downstream of the upstream edge (169) of a splitter (165) and no fluid communication between a chamber (162) and either of the diverging diffuser legs downstream of the splitter edge. In other embodiments, a turbulent flows generator is formed by use of bump step (202), pins (220, 230), surface discontinuities (250) or a combination thereof.

21 Claims, 4 Drawing Sheets

FLUIDIC OSCILLATOR

TECHNICAL FIELD OF THE INVENTION

This invention relates to a fluidic oscillator which causes fluid to flow alternatively from one outlet port and another outlet port in a continual manner.

BACKGROUND OF THE INVENTION

U.S. Pat. No. 5,165,438 discloses two fluidic oscillators, each of which employs a wedge-shaped splitter to route the flow of a fluid down diverging diffuser legs. In one oscillator, a feedback passageway from each leg is routed back to the flow path upstream of the splitter to create a condition establishing oscillating flow through the legs. In a second oscillator, a passageway between the legs downstream of the upstream end of the splitter creates a condition establishing oscillating flow through the legs.

While these designs have proven quite effective, the passages required to establish oscillation are expensive to fabricate and prone to clogging from debris in the fluid. In addition, in some such designs cavitation damage has occurred in the device adjacent to the transverse passage, eroding the walls of the diverging diffuser legs. Further, impurities in the flow have been found to erode the upstream end of the splitter. A need exists to provide an even more effective fluidic oscillator design which is reliable, long-lived and economical.

SUMMARY OF THE INVENTION

In accordance with one aspect of the present invention, a fluidic oscillator is provided which includes a body. The body forms a flow path including an inlet passage, a jet nozzle, a chamber adjacent to the jet nozzle, a pair of diverging diffuser legs having a splitter therebetween and an outlet port in communication with each of the diffuser legs. In one configuration, the body is configured to create an oscillating flow through the diffuser legs with no fluid communication between the legs downstream of the splitter and with no fluid communication between a leg downstream of the splitter and the chamber.

In another configuration of the present invention, the body defines a turbulent flow generator extending into the flow path upstream of the nozzle to create an oscillating flow through the diffuser legs. In another aspect of the present invention, the turbulent flow generator is a replaceable member. In accordance with another aspect of the present invention, the turbulent flow generator can be a pin, a surface finish or a step transition between the inlet passage and jet nozzle. In accordance with another aspect of the present invention, the turbulent flow generator can be reconfigurable to adapt the fluidic oscillator for different flow conditions.

In yet another aspect of the current invention, the body defines a supplemental turbulence generator in each of the diffuser legs.

In still another aspect of the present invention, a method is provided for using a fluidic oscillator to produce transient over-pressure pulses in the surrounding fluid medium in addition to the steady pressure pulses caused by steady oscillation.

BRIEF DESCRIPTION OF THE DRAWINGS

The present invention has other objects, features and advantages as will become more apparent in connection with the following detailed description, taken in conjunction with the appended drawings in which.

DETAILED DESCRIPTION OF THE INVENTION

Figure 1:
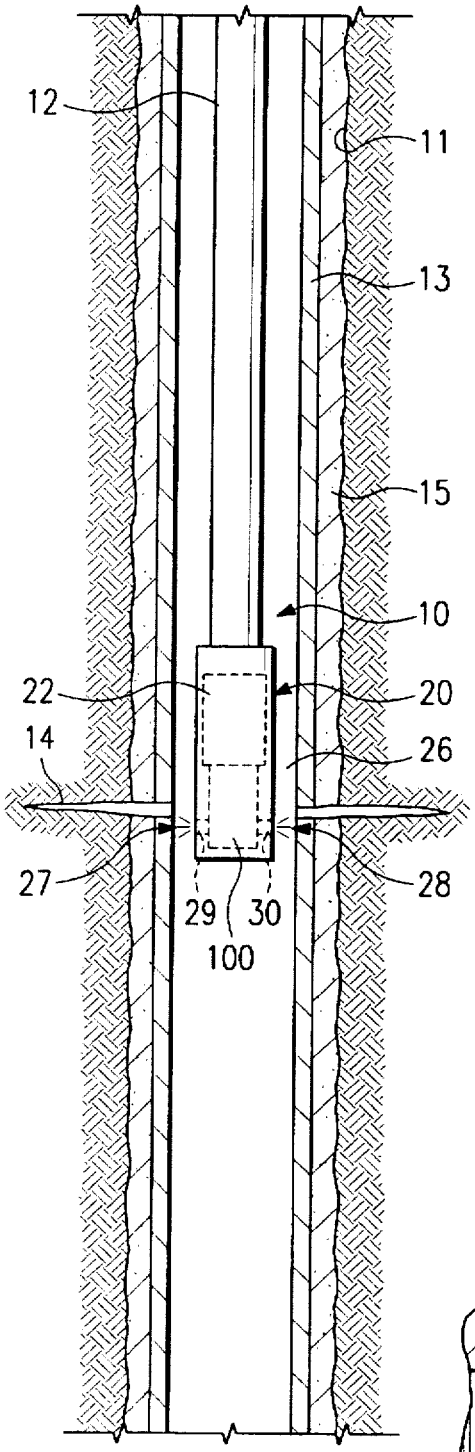
FIG. 1 is a schematic view of a well operation using a fluidic oscillator in accordance with the present invention.

With reference now to the figures, an improved fluidic oscillator 100 will be described. With reference to FIG. 1, the fluidic oscillator 100 will be suspended as part of well tool 10 in a wellbore 11 on a running string 12 of tubing, or the like. In a well operation, for example, perforation cleaning, the wellbore 11 is lined with casing 13 which has been cemented at 15 and then perforated at 14 in order to communicate the bore of the casing with the earth formations which surround it. Where the well tool 10 is used in connection with the drilling of a wellbore, for example to increase the rate of penetration of the bit, the casing would not yet have been installed. While the present invention will be described mainly in connection with perforation cleaning, it will be recognized that the invention can be used in other well applications, for example, drilling, and numerous industrial applications, for example, pneumatic tools and the like.

Figure 2:
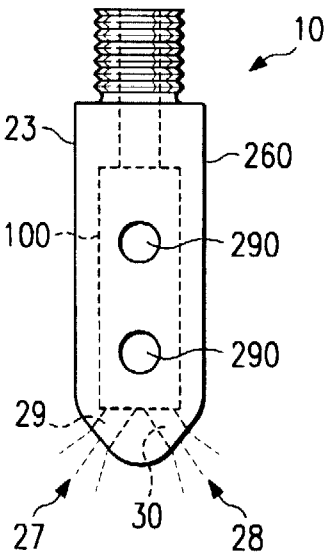
FIG. 2 is a plan view of a well tool incorporating a fluid oscillator forming a first embodiment of the present invention.

Referring now also to FIG. 2, the well tool 10 incorporating fluidic oscillator 100 can be a multipurpose tool sub 20 (FIG. 1) which can also incorporate other tools or instruments 22, or it can be a single purpose tool, for example, a perforation cleaner 23 (FIG. 2). The fluidic oscillator 100 functions to generate alternating fluid jets 27, 28 which flow successively through outlet ports 29 and 30 in a continual manner. The alternating fluid jets 27, 28 produce pressure fluctuations in the fluids in the well annulus 26 outside the tool. Such pressure fluctuations can, for example, have a peak to peak value in the order of about 2000 psi, and a frequency within the range of about 100 Hertz to about 200 Hertz. In one example, where the standing or hydrostatic head pressure may be 2500 psi at the depth of the tool 10, the pressure fluctuations are made to vary between about 1500 psi and about 3500 psi. The pressure fluctuations create alternating compression and tension loads on anything in the vicinity of the oscillator 100, for example the material that may be plugging the walls of the perforations 14 and reducing the productivity of the well. The cyclical loading causes disintegration of such materials so that it can be flushed out of the perforation tunnels by formation pressure.

Figure 3A:
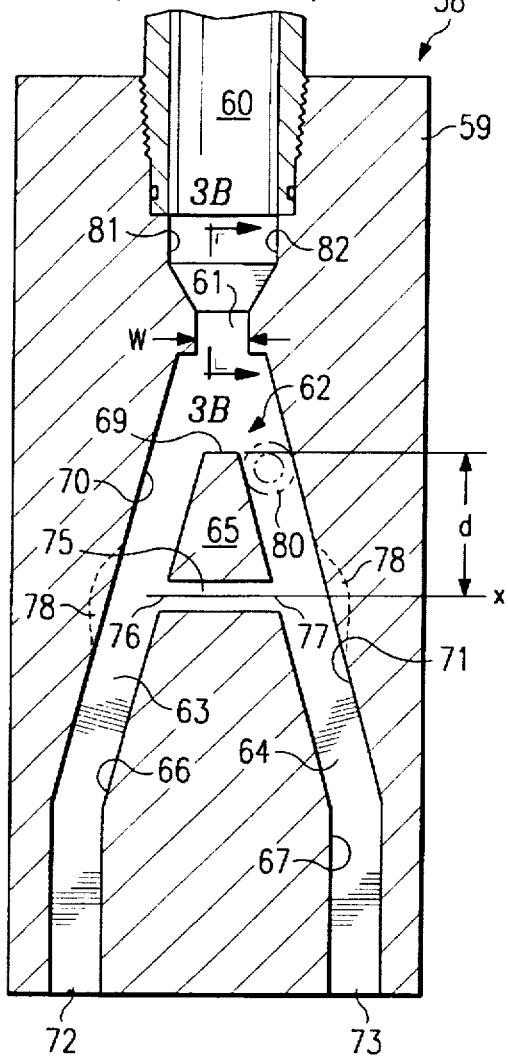
FIG. 3A (PRIOR ART)
FIG. 3A is a cross-sectional view of a conventional fluidic oscillator.
Figure 3B:
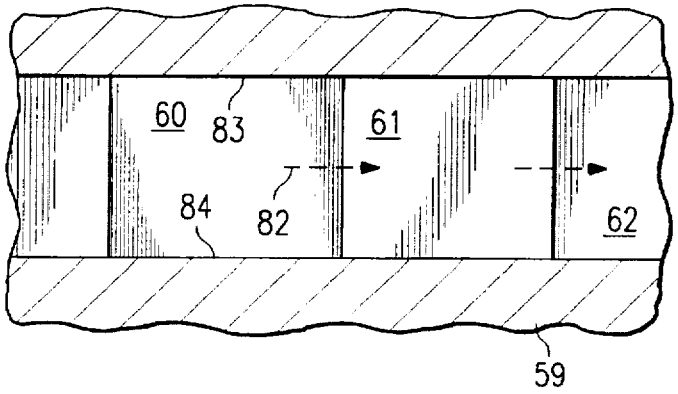
FIG. 3B (PRIOR ART)
FIG. 3B is a cross-sectional view of the fluidic oscillator of FIG. 3A taken along line 3B—3B.

With reference now to FIGS. 3A and 3B, a prior art fluidic oscillator 58 is illustrated of the type disclosed in U.S. Pat. No. 5,165,438 issued Nov. 24, 1992, which patent is hereby incorporated in its entirety by reference herein. Fluidic oscillator 58 is mounted in a block 59 and has an initial fluid path comprising a fluid inlet passage 60, a nozzle 61, and a chamber 62, all of which are generally rectangular in cross section (taken perpendicular to the main flow path) and defined by lateral walls 81, 82 (FIG. 3A) and top and bottom walls 83, 84 (FIG. 3B). Fluid inlet passage 60 leads from a fluid source (for example, tubing string 12) and then narrows to form nozzle 61 having a lateral width denoted by reference letter W. The main jet, which issues from the nozzle 61, enters a chamber 62 located at the upper end of a pair of diffuser legs 63, 64 which diverge laterally outward. FIG. 3B shows a lateral cross-sectional view (i.e., viewed in the direction of divergence between the diffuser legs) of the initial flow path including portions of passage 60, nozzle 61, and chamber 62. As best seen in FIG. 3B, in prior art fluidic oscillators the top and bottom walls 83, 84, respectively, defining the initial flow path from fluid inlet passage 60 to chamber 62, are generally smooth and parallel to one another. In FIG. 3B, the direction of fluid flow is shown by the arrow denoted by reference numeral 82. The inner walls 66, 67 of the legs 63, 64 define the opposite side walls of a generally wedge-shaped splitter 65 which has a narrow edge surface 69 at its upstream end. The outer sides 70, 71 (which are actually continuations of lateral walls 81, 82) of the legs 63, 64 also are formed parallel to inner side wall 66, 67. Outlet passages 72, 73, which communicate with the respective lower ends of the legs 63, 64, lead to outlet ports 29, 30, respectively, and thus to the environment in which the oscillator is used. A transverse passageway 75 extends through the body of the splitter 65 in a manner such that its opposite ends 76, 77 are in communication with respective diffuser legs 63, 64. The passage 75, whose longitudinal axis (denoted by reference letter x) is located at a predetermined distance (denoted by reference letter d) below the upper edge surface 69 of the splitter 65, functions in the nature of a vacuum port in that high velocity flow passing either of its ends 76 or 77 creates a negative pressure condition in whichever leg is opposite to the leg through which the main jet is flowing. Such alternating negative pressure conditions cause the main jet flowing downward in the chamber 62 to be switched back and forth between the diffuser legs 63–64 and thereby create pressure fluctuations which are transmitted to the surrounding medium by the outlet passages 72, 73. Fluid under pressure is supplied to fluid entry path 60 at a selected rate, for example, 1.5 barrels per minute. The flow is accelerated through the jet nozzle 61 into the chamber 62. Instead of being split in half by the splitter 65, most of the jet flow tends to lock onto the side wall and flow into only one of the diffuser legs 63 or 64, for example the leg 63 as shown in FIG. 3A, where it then exits via the outlet passage 72. This attachment is a manifestation of the so-called Coanda Effect of fluid dynamics. As the jet flows down the leg 63, a part thereof is peeled off by the leading edge surface 69 of the splitter 65 and forms a vortex 80 at the upper end of the opposite leg 64. This flow condition will tend to remain unchanged unless and until the fluid jet is disturbed enough to make it switch over to the other diffuser leg 64. In prior art oscillators such as shown in FIG. 3A, in response to flow of the main jet stream down the leg 63, a slight vacuum or negative pressure condition is created at the end 76 of passage 75 which is communicated to the other diffuser leg 64 by the opposite end 77 thereof. This negative pressure condition first dissipates the vortex 80 at the upper end of leg 64 and then pulls the jet stream across the leading edge surface 69 until the main jet flow is diverted or switched over into the leg 64 where it then exits through the outlet passage 73. A vortex similar to vortex 80 will then form near the upper end of diffuser leg 63 by reason of the same effect mentioned above. However, soon the slight negative pressure condition created by the flow down leg 64 past the end 77 of the passage 75 is communicated to leg 63 and dissipates this new vortex, after which the negative pressure condition pulls the jet stream back across the edge surface 69 of the splitter 65 so that the main jet is once again flowing down the leg 63 and out the outlet passage 72. With a steady rate of fluid flow supply to the inlet passage 60, the switching will occur in a continual and cyclical manner that produces pressure fluctuations or waves in the well annulus which can have a peak to peak value and a resonant frequency as noted above.

While the design of fluidic oscillator 58 is effective, it has been found that wear occurs to the splitter 65 due to impurities in the fluid flow. In severe wear conditions, the splitter can be worn downstream to the passage 75. In addition, debris in the flow can clog passage 75, stopping oscillation or rendering it less predictable. Further, damage 78 (shown in phantom) has been found in sidewalls 70 and 71 adjacent the ends of the passage 75. Such damage is believed to occur from vacuum-induced cavitation in the passage.

With reference now to FIGS. 4–9B, various versions of the improved fluidic oscillator 100 will be described that are believed to overcome the noted disadvantages of the prior art fluidic oscillator 58 described previously. With reference to FIG. 4–9B, many elements of the fluidic oscillator 100 are substantially identical to that found in fluidic oscillator 58 and are identified by the same reference numerals with 100 added. However, fluidic oscillator 100 does not use a vacuum port or passage 75. The passage is either never formed in the fluidic oscillator 100 or it is blocked off. Therefore, unlike prior art oscillators, there is no fluid communication between the diffuser legs 163, 164 downstream of the upper end 169 of the splitter plate. Neither is there any fluid communication from a diffuser leg 163 or 164 to any point in the flow path upstream of the upper end 169 of the splitter plate. In the present invention, oscillating flow is established through the diffuser legs 163, 164 by the interaction of Coanda Effect attachment of the fluid flow to the sides of the chamber and friction pressure created by turbulence in the fluid flow down the diffuser legs.

Figure 4:
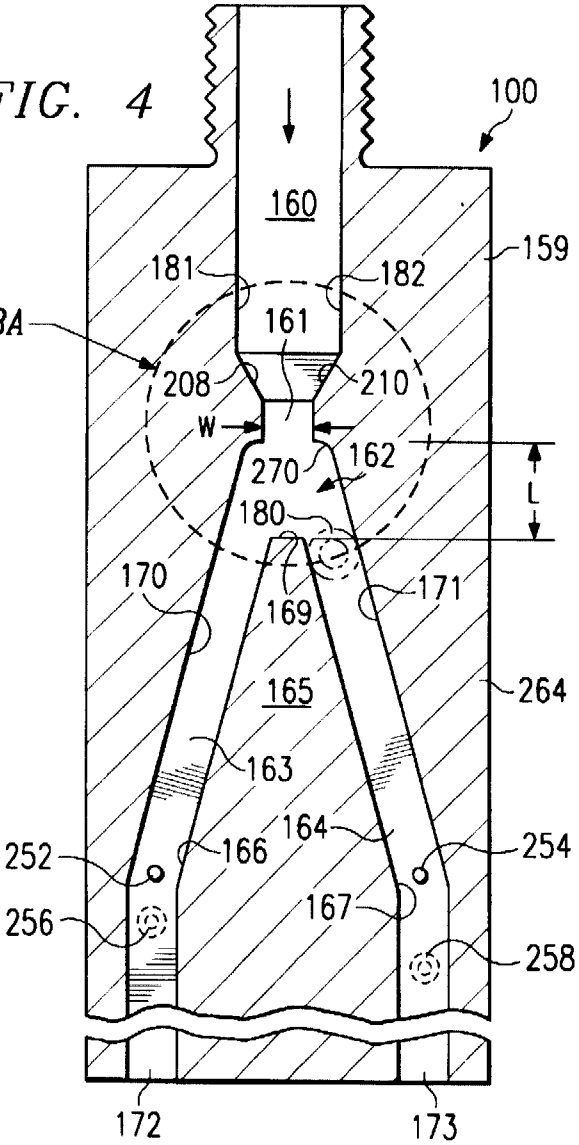
FIG. 4 is a cross-sectional view of a fluidic oscillator forming a first embodiment of the present invention.

With reference to FIG. 4, the width of the jet nozzle 161 can be seen to be W. The distance from the exit of the jet nozzle 161 to the edge surface 169 of the splitter 165 can be seen to be L. If L is less than W, the Coanda Effect attachment of the fluid flow to the walls of the chamber is so weak that switching is unlikely to occur. If L is within the range from about 1W to about 3W, the Coanda Effect attachment of the fluid stream to the walls of the diffuser legs 163 and 164 is not strong; however, it is sufficient to allow switching to occur. If L is within the range of about 3W to about 6W, the Coanda Effect attachment of the fluid stream to the walls of the diffuser gets stronger as L gets larger relative W, and this range provides optimum support for switching. If L becomes greater than about 6W, the Coanda Effect attachment of the fluid stream to the wall of the diffuser becomes so strong that switching reliability may be adversely affected. Thus, it is desirable to keep L within a range of about 1W to about 6.5W and preferably within the range of about 2.9W to about 6W to properly utilize the Coanda Effect. The leading edge 169 in a newly manufactured oscillator 100 is preferably located with L at the smaller end of the preferred range of distance to allow for fluid erosion of edge 169 during the life of the tool.

As will be described in greater detail hereinafter, other versions of the fluidic oscillator 100, shown in FIGS. 5A–9B, use a turbulent flow generator positioned in the fluid entry path 160 or between the fluid entry path 160 and the jet nozzle 161 to increase the friction pressure of the fluid flowing down the selected diffuser leg to establish oscillating flow through the legs. The use of such a turbulent flow generator has been found to create supplemental vortices which affect the switching of flow between the diffuser legs 163 and 164 to produce desirable modes of oscillation.

Figure 5A:
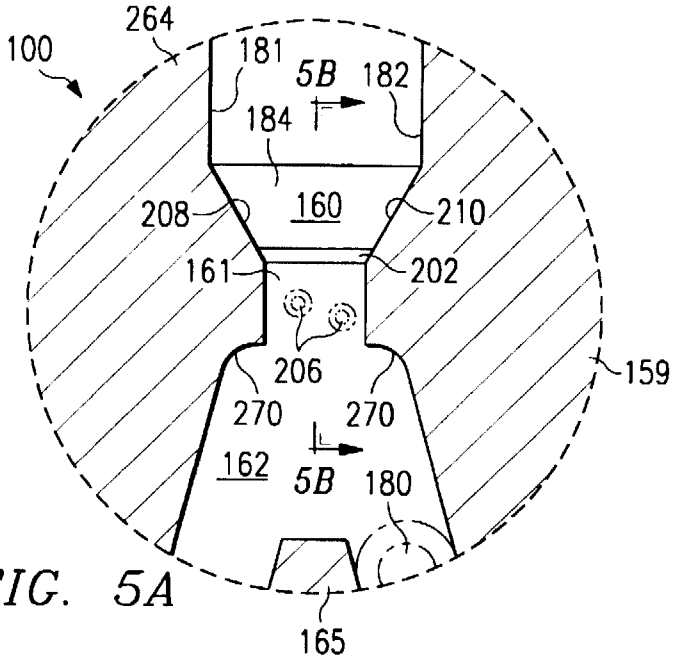
FIG. 5A is an enlarged view of a portion of the fluidic oscillator of FIG. 4 illustrating a first turbulent flow generator.
Figure 5B:
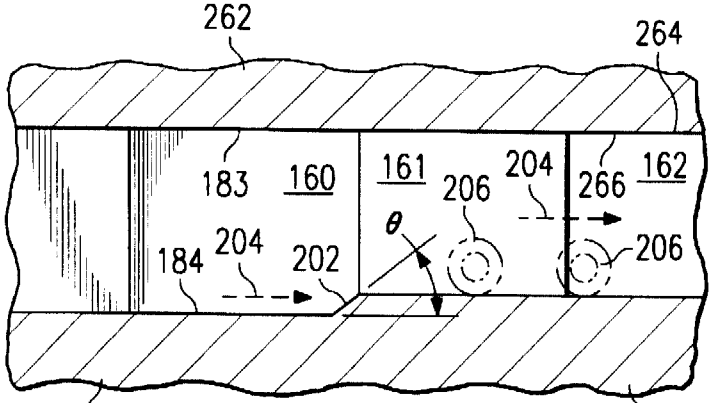
FIG. 5B is a cross-section of the FIG. 5A taken along line 5B—5B.

With reference to FIGS. 5A and 5B, a first version of a turbulent flow generator in the fluidic oscillator 100 is formed by a bump step 202 formed in one of the top and bottom walls 183, 184, respectively, forming a transition between the fluid inlet passage 160 and the jet nozzle 161. It can be seen in FIG. 5B that the bump step 202 extends at an angle θ relative the direction of flow represented by arrows 204. The bump step 202 forms supplemental vortices 206 downstream therefrom which affect the rate of oscillation of the fluidic oscillator 100. The angle θ can vary between about 35° to about 90°, preferably between about 45° and about 90°. The bump step 202 also need not extend laterally the full width of the passage.

The supplemental vortices 206 produced by bump step 202 (or other versions of the turbulent flow generator as shown in FIGS. 6A–9B) are distinguished from the turbulence and vortices produced by other transition surfaces, such as lateral transition surfaces 208, 210 as follows: The turbulence and vortexes generated from the lateral transition surfaces 208 and 210 are generated on the lateral walls 181, 182 and tend to remain attached thereto and thus go down the respective diffuser legs 163 and 164, creating no switching effect. In contrast, the bump step 202 produces turbulence and vortexes 206 down the center (with respect to lateral walls 181, 182) of the flow path. Since these vortexes 206 are not attached to either lateral wall 181, 182, they are entrained in the main fluid flow and carried down the selected diffuser leg and produce therein increasing friction pressure which eventually overcomes blocking vortex 180 (at the entrance to the non-selected leg) and causes the flow to switch over into the other diffuser leg, creating the desired oscillating effect. Changing the number and location of these supplemental vortices 206 thereby affects the frequency of oscillation of oscillator 100.

Since excessive turbulence in the fluid flow can disrupt the Coanda effect and cause oscillator 100 to malfunction, the lateral surfaces 208 and 210 are preferably formed at an angle within the range of about 15° to about 28° with respect to the flow direction.

While the bump step 202 is seen as part of a transition between the fluid inlet path 160 and the jet nozzle 161, the bump step can be positioned anywhere within the initial flow path of the oscillator and still be effective to generate oscillation producing supplemental turbulence and vortexes.

Figure 6A:
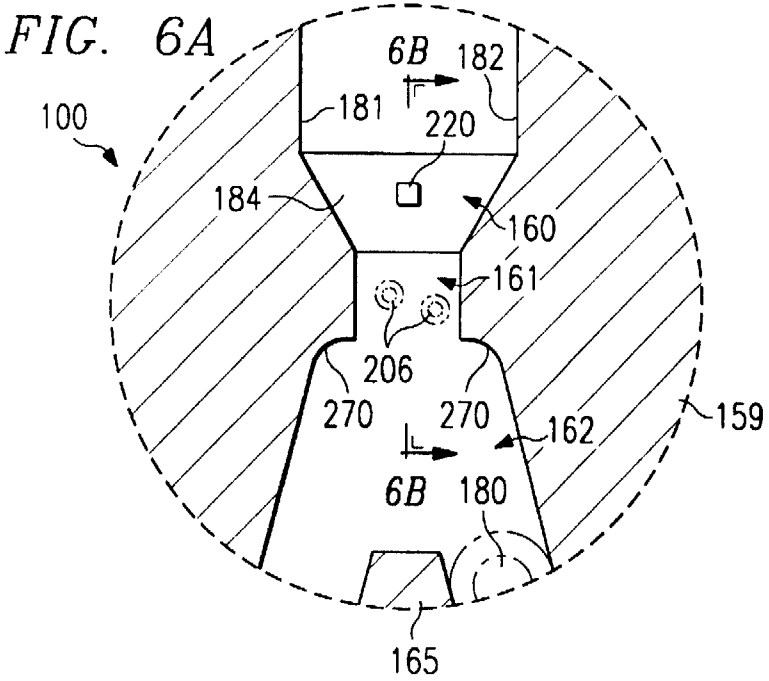
FIG. 6A is an enlarged cross-sectional view of a portion of the fluidic oscillator illustrating a second type of turbulent flow generator.
Figure 6B:
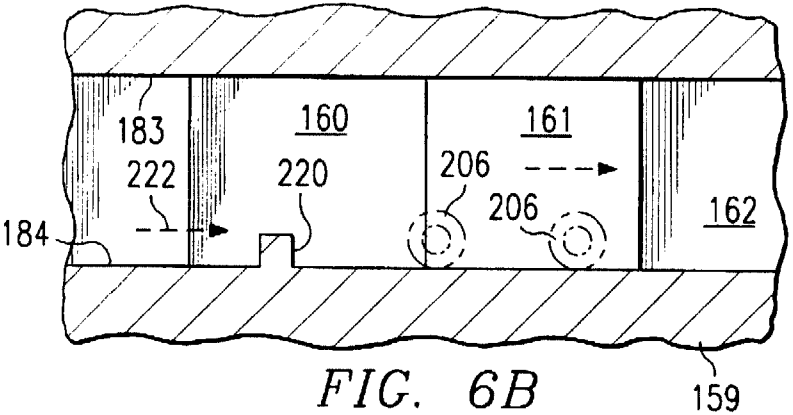
FIG. 6B is a cross-sectional view of the oscillator of FIG. 6A taken along line 6B—6B.

With reference to FIGS. 6A and 6B, a modification of the fluidic oscillator 100 is illustrated which employs a turbulent flow generator formed by a pin 220 extending into the flow path 222 from the bottom surface 184 of the fluid inlet passage 160. The pin 220 can be formed of the same material as the rest of oscillator 100 or it can be formed of a separate material, preferably, an abrasion resistant material, for example, tungsten carbide. In the embodiment of FIGS. 6A and 6B, the pin 220 is of square cross-section and is formed integrally with the body. However, pin 220 can have any desired cross-section, for example, circular, triangular, hexagonal, etc. As can be seen in the figures, the pin 220 generates supplemental vortices 206 downstream which change the oscillation effect.

Figure 7A:
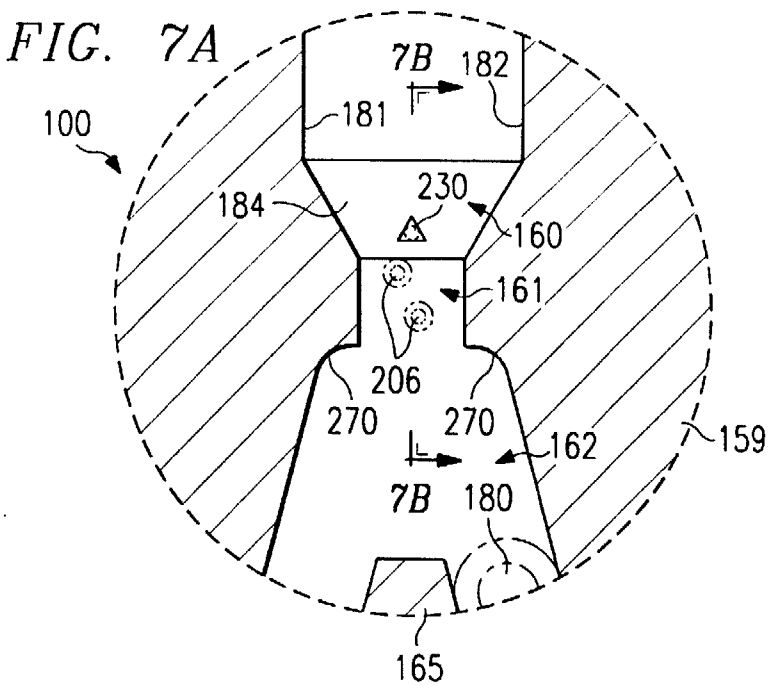
FIG. 7A is an enlarged cross-sectional view of a portion of the fluidic oscillator illustrating a third turbulent flow generator.
Figure 7B:
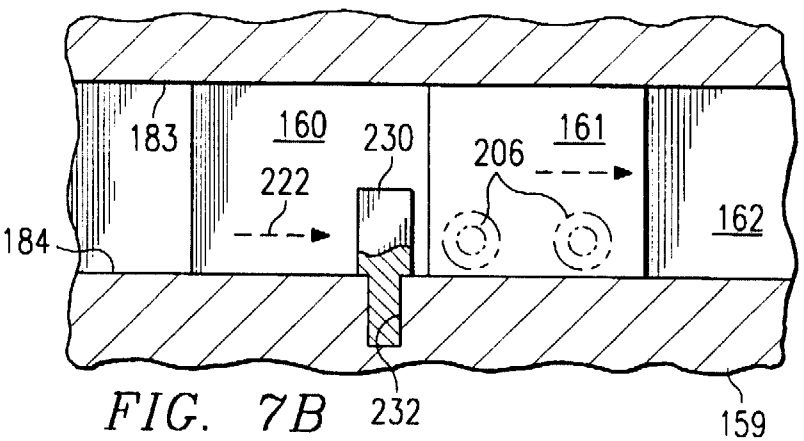
FIG. 7B is a cross-sectional view of the oscillator of FIG. 7A taken along line 7B—7B.

With reference to FIGS. 7A and 7B, another version of fluidic oscillator 100 is illustrated which incorporates the use of a removable pin 230. Again, pin 230 is preferably made of an abrasion resistant material for example, tungsten carbide. A hole 232 is formed in the bottom surface 184 of the fluid inlet passage 160 to receive the pin 230. The pin can be retained in the hole 232 by interference fit, threads, welding, adhesive, or other suitable securing technique. The removable pin 230 has the advantage of being replaceable. If the pin 230 erodes due to abrasion effects of the fluid, the pin will decrease in effectiveness in creating vortices 206. The pin 230 can then be removed from the hole 232 and replaced with a new pin to revive performance of the oscillator 100. While pin 230 is shown to have a triangular cross-section, other shapes can be used such as described for pin 220.

Figure 8A:
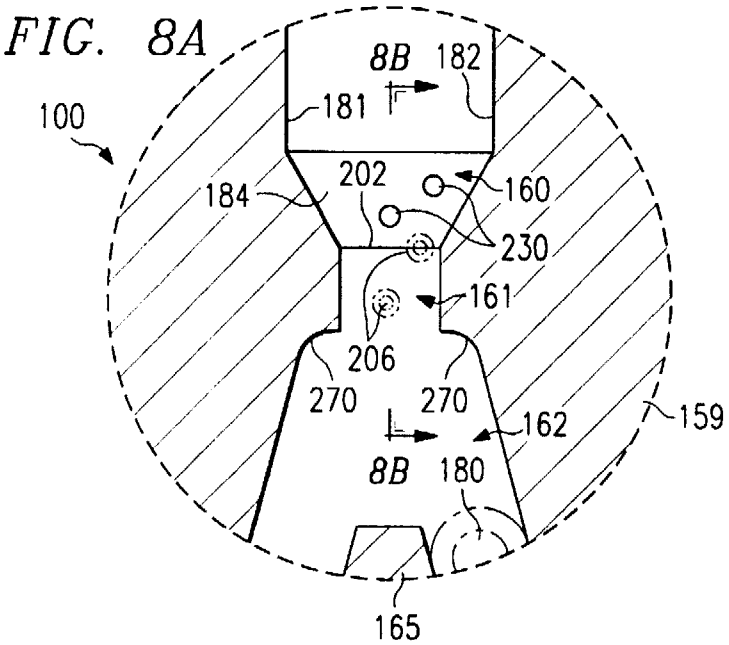
FIG. 8A is an enlarged cross-sectional view of a portion of the fluidic oscillator illustrating a fourth type of turbulent flow generator.
Figure 8B:
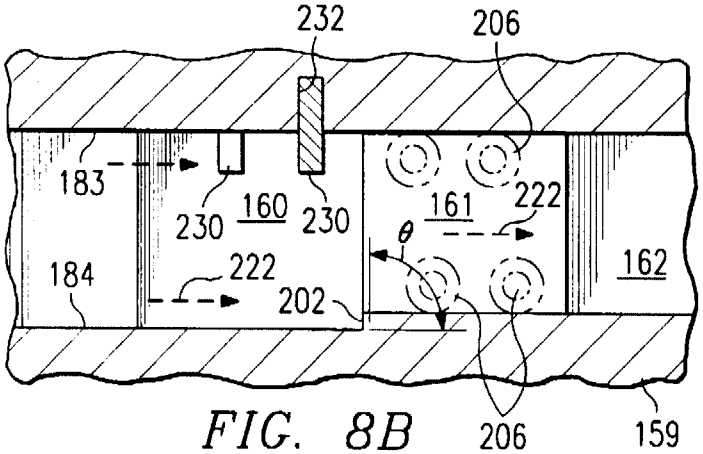
FIG. 8B is a cross-sectional view of the oscillator of FIG. 8A taken along line 8B—8B.

FIGS. 8A and 8B show another version of the fluidic oscillator 100 which incorporate a plurality of holes 232 that can be in both the bottom surface 184 and top surface 183 of the fluid inlet passage 160 to receive one or more removable pins 230. In the example shown in FIGS. 8A and 8B, pins 230 are located in top wall 183 only; however, it will be understood that pins 230 could be located in any or all of the holes 232. Not all of the holes 232 need to receive pins 230, providing an aspect of reconfigurability to the fluidic oscillator 100. The position, configuration and number of the pins 230 will determine the particular operating characteristics of the fluidic oscillator 100 and, by positioning the pins in various ones of the holes 232 provided, the fluidic oscillator 100 can be tuned to a particular application.

The version of FIGS. 8A and 8B also shows use of a bump step 202 having an angle θ of 90° with respect to flow direction 222. This illustrates that multiple types of turbulent flow generators can be used in combination in a single fluidic oscillator 100 to produce a variety of supplemental vortexes 206 throughout the flow path 222.

Figure 9A:
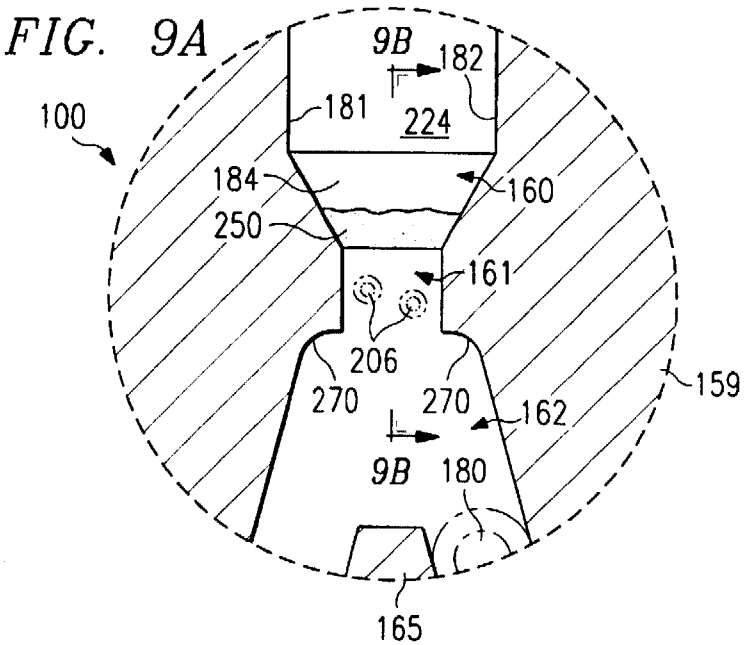
FIG. 9A is an enlarged cross-sectional view of a portion of the fluidic oscillator illustrating a fifth type of turbulent flow generator.
Figure 9B:
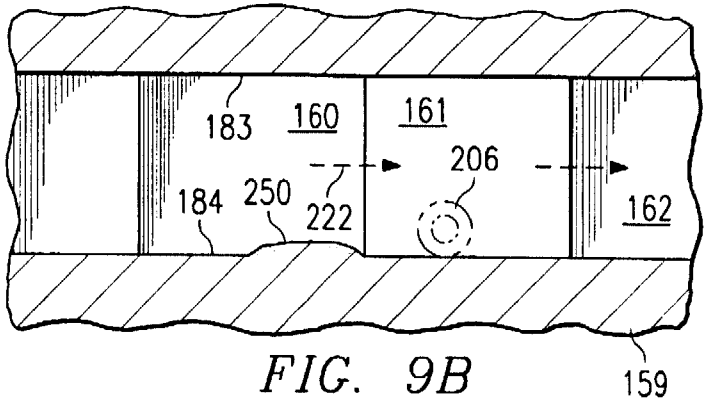
FIG. 9B is a cross-sectional view of the oscillator of FIG. 9A taken along line 9B—9B.

With reference now to FIGS. 9A and 9B, another version of the fluidic oscillator 100 is illustrated which can be seen to have surface discontinuities 250 on the bottom surface 184 of the inlet passage 160. These discontinuities 250 can be formed by a roughened surface, bumps, ridges, and the like which generate supplemental vortices 206 downstream therefrom. While shown on the bottom surface 184, the discontinuities 250 can be formed, instead, on top surface 183. Alternatively, discontinuities 250 can be formed on both surfaces 183 and 184.

When the present invention is used in connection with a well tool, for example, the formation cleaning device 10, fluid is pumped down the tubing 12 at a selected rate, for example at about 2 barrels per minute. The flow goes through the fluid inlet passage 160 and flows into nozzle 161 (in the version of FIG. 4) or across the turbulent flow generator (in the version of FIGS. 5A–9B), whether it be a bump step 202 or a protrusion such as pins 220 and 230, which creates supplemental vortices within the fluid stream due to the shearing action of the fluid layers encountering the turbulent flow generator. The fluid stream is accelerated through the jet nozzle 161 into the chamber 162. However, instead of being split in half by the splitter 165, most of the fluid flow tends to lock onto one side wall of chamber 162 and flow into only one of the diffuser legs 163 or 164, for example diffuser leg 163 as shown in FIG. 4, where it exits via the outlet passage 172. As the fluid stream flows down the selected leg 163, a part thereof is peeled off by the leading edge surface 169 of the splitter 165 and forms a blocking vortex 180 at the upper end of the opposite (non-selected) leg 164. This flow condition will tend to remain unchanged unless and until the fluid jet is disturbed enough to make it switch over to the other diffuser leg.

In response to the creation of vortices within the stream flow by the basic configuration of FIG. 4 or of the supplemental vortices 206 produced by the turbulent flow generator of FIGS. 5A–9B, the friction pressure within the selected diffuser leg, for example leg 163, increases as the main flow stream continues down the selected diffuser leg 163 toward the outlet passage 172. When the friction pressure in selected leg 163 increases to a sufficient level, the blocking action of the vortex 180 on other (non-selected) leg 164 is overcome and vortex 180 is dissipated. As the vortex 180 collapses, the sudden negative pressure at the upper end of the diffuser leg 164, which is created by the collapse of the vortex 180, pulls the main stream flow from leg 163 across the leading edge 169 of the fluid splitter 165 and into the diffuser leg 164 (which now becomes the selected leg) where it exits via outlet passage 173. Then a new vortex similar to vortex 180 will form near the upper end of the (now non-selected) diffuser leg 163 by reason of the same effect mentioned above. However, as the main stream flow continues down selected diffuser leg 164, the supplemental vortices will cause the friction pressure within the selected diffuser leg 164 to increase to sufficiently high levels, due to the multiple vortices mentioned above, and the blocking action of the vortex on non-selected diffuser leg 163 will collapse. The sudden negative pressure condition developed at the upper end of diffuser leg 163 will pull the main stream flow back across the leading edge 169 of the fluid splitter 165 and into the diffuser leg 163 (which now again becomes the selected leg) where it exits again via the outlet passage 172. With a steady rate of fluid flow supplied to the inlet fluid inlet passage 160, the switching cycle just described will occur in a continual and cyclical manner that produces pressure fluctuations or waves which can have a peak to peak value and a resonant frequency as noted above.

Referring again to FIG. 4, in another embodiment of the current invention fluidic oscillator 100 includes a supplemental vortex generator 252, 254 formed in each of diffuser legs 163, 164, respectively, between the upper end 169 of the splitter plate and the outlet passages 172, 173. When fluid flows down one of the diffuser legs 163, 164, the corresponding supplemental vortex generators 252 or 254 produce additional vortexes 256, 258, respectively, which increase the friction pressure of the fluid in association with the vortexes 206 (FIG. 5A) produced by the turbulent flow generator. The supplemental vortex generator can be used to establish the oscillating flow in the diffuser legs when the fluid flow rates, fluid viscosity, or other flow parameters of the oscillator's usage make it difficult to establish oscillation using the upstream turbulent flow generator alone. In terms of construction, the supplemental vortex generators 252, 254 can be formed in any of the ways previously described for the upstream turbulent flow generator. Thus, while the supplemental vortex generators 252, 254 in FIG. 4 are shown comprising pins with a round cross-section, it will be apparent that pins of various shapes, cross-sections, and numbers, fixed or removable, can be used, as can bump steps and surface roughness, to form the supplemental vortex generators. Further, the placement of the supplemental vortex generators 252, 254 along the diffuser legs 163, 164 can be adjusted upstream or downstream from the position shown in FIG. 4 if required by flow conditions.

The pressure oscillations induced in the flow by the fluid oscillator can be used in many ways. For example, where the tool 10 is used for cleaning perforations 14 which extend through the wall of the casing 11 and out into the surrounding earth formation, the pressure fluctuations cause cyclically changing compression and tension loading to be applied to any material that may be plugging or partially blocking the perforations. The pressure fluctuations cause additional stresses on the plugging material through the process of cavitation. As a result, the material is disintegrated so that formation pressure and flow can flush the debris out into the wellbore 11. When the tool is used in connection with drilling, the hold down forces on the rock chips due to the hydrostatic head of the drilling mud are effectively reversed during each negative-going portion of each pressure fluctuation. During each reduced pressure phase, the chips are propelled upward into the mud circulation by formation pressure to increase the rate of penetration of the bit. The structures and principles of operation of the present invention also are applicable to other wellbore uses and industrial applications. Thus, the disclosure of the present invention in connection with a well tool is to be considered merely as exemplary, and not limiting.

As a matter of construction, the fluidic oscillator 100 can be a separate device incorporated into an assembly comprising well tool 10 or it can be integrally formed with well tool 10. In the embodiment shown in FIGS. 4, 5A and 5B, oscillator 100 is preferably formed in two sections, including a main body 260 and a top 262 (FIG. 5B) which are bolted together by bolts 290 (FIG. 2). As can be seen in FIGS. 4, 5A and 5B, the main body 260 has a planar surface 264 into which is machined the various passages necessary to form the oscillator 100 in the desired configuration. The lower surface 266 of top 262 which mates with surface 264 is preferably flat, with the exception of any holes 232 or pins 220 or 230 which extend therefrom, as desired. As shown in FIG. 5B, the lower surface 266 of top 262 forms the top surface 183 of the fluid passages. This permits the majority of machining necessary to form the oscillator 100 to be done to a single part of well tool 10.

An important consideration is the transition from the jet nozzle 161 to the chamber 162. Preferably, the transition is formed by radiused corners 270 as seen in FIGS. 4, 5A, 6A, 7A, 8A and 9A. Preferably, all of the passages forming the ports, legs, nozzles and entry path have a rectangular or square cross-section (taken generally perpendicular to the flow direction) with 90° corners. While the diffuser legs are illustrated as being diverging after the splitter 165, only the walls of the chamber 162 must diverge in order to establish the required oscillation behavior.

By providing multiple positions for turbulent flow generators, for example, multiple holes to receive pins 230, a specific fluidic oscillator 100 can be readily reconfigured for different frequencies or flow conditions. Thus, the oscillator becomes a custom configurable tool and can be custom configured for many types of jobs, for example, scale removal, paraffin removal or use with drilling mud or formation fines. In addition, the elimination of feedback loops or connecting passages allows a reduction in the size of the fluidic oscillator 100 over prior designs.

Another aspect of the current invention is a method of using a fluidic oscillator to produce transient over-pressure pulses in the surrounding fluid medium in addition to the steady pressure pulses caused by continual switching. Prior art fluidic oscillators using feedback passages or lateral vacuum passages have very stable oscillating characteristics such that once oscillation begins, they will continue to oscillate steadily (that is, the oscillating frequency will change slowly, if at all) even if the inlet flow rate changes (provided it does not fall below a minimum rate). In contrast, a fluidic oscillator according to the present invention can have oscillating characteristics which cause it to oscillate steadily when the fluid is supplied at a constant flow rate, but to stop oscillating or oscillate erratically (that is, with rapidly changing frequency) during a transient time when the inlet flow rate changes from one constant rate to another, and then to spontaneously begin oscillating steadily again once a new constant flow rate is maintained. If the surrounding fluid medium and/or the environment, for example, the rock formations surrounding the well bore, are vibrating at the frequency of steady pulses from oscillator 100, then a sudden cessation of the steady oscillation by oscillator 100 can cause transient conditions of rapid pressure change, known as over-pressure pulses or spikes, in the fluid medium surrounding fluidic oscillator 100. These over-pressure pulses can produce peak pressures at least 10% higher than the peak pressures of steady oscillation, thereby greatly increasing the effectiveness of the oscillator to clean well perforations, dislodge rock chips, or produce other beneficial effects.

One method for producing such over-pressure pulses is to sequentially change the inlet flow rate to oscillator 100 between different constant flow rates, allowing sufficient time between each rate change for the oscillator to resume steady oscillation. If necessary, the oscillation status of the oscillator, i.e., whether or not it is oscillating steadily, can be determined by using an acoustic sensor attached to the oscillator supply tubing or by using pressure transducers or other electronic sensors. For example, transient over-pressure pulses can be generated in an environment by the steps of:

(a) flowing a fluid through a fluidic oscillator at a first flow rate for a period of time sufficient to produce a steady oscillating flow at a first frequency;

(b) changing the flow rate at which the fluid flows through the fluidic oscillator until the steady oscillation at the first frequency stops;

(c) defining the flow rate at which the steady oscillation at the first frequency stopped as a second flow rate;

(d) flowing the fluid through the fluidic oscillator at the second flow rate for a period of time sufficient to produce a steady oscillation at a second frequency;

(e) re-defining the second flow rate as a new first flow rate and re-defining the second frequency as a new first frequency; and (f) repeating steps (a)–(e) sequentially producing over-pressure pulses in the environment each time the steady oscillation at the first frequency stops.

The characteristics of the fluidic oscillation 100 with respect to oscillation stability (or lack thereof) necessary to produce transient pulses can readily be adjusted by changing the ratio of nozzle width W to nozzle-splitter distance L, by the use of turbulence generators as shown in FIGS. 5A–9B, by the use of supplemental vortex generators as shown in FIG. 4, or a combination of these.

Although several embodiments of the invention have been illustrated in the accompanying drawings, and described in the foregoing detailed description, it will be understood that the invention is not limited to the embodiments disclosed, but is capable of numerous rearrangements, modifications and substitution of parts and elements without departing from the scope and spirit of the invention.

I claim:

1. A method of generating pulsating fluid pressures that are applied to an environment, comprising the steps of:

providing a fluidic oscillator, comprising a body forming an inlet passage, a jet nozzle, a chamber adjacent said jet nozzle, a splitter having an upstream edge with a lateral width, said upstream edge disposed substantially perpendicular to the direction of flow through said nozzle and defining a portion of a downstream wall of said chamber opposite said nozzle, first and second diffuser legs, said diffuser legs diverging laterally from one another, each said diffuser leg including an upper end and an outlet passage, each said upper end being disposed laterally adjacent said upstream edge of said splitter, said upper ends being disposed on opposite sides of said splitter from one another, each said diffuser leg running continuously between its respective upper end and its respective outlet passage and having no other fluid connection;

flowing fluid through said nozzel at a substantially continuous rate to generate vortices which are carried into one of said diffuser legs by a fluid stream which is attached to a lateral wall of said chamber causing the flow to be primarily through said one of said diffuser legs until friction pressure in said one of said diffuser legs caused by said vortices causes the main flow to shift until the flow is primarily through the other of said diffuser legs;

whereby said primary flow will continue to switch between said one of said diffuser legs and said other of said diffuser legs in an oscillating manner.

2. The method of claim 1 wherein said fluidic oscillator includes a turbulent flow generator disposed in said inlet passage and extending into said flow path.

3. A method of generating transient over-pressure pulses that are applied to an environment, comprising the steps of:

(a) providing a fluidic oscillator, comprising a body forming an inlet passage having a turbulent flow generator disposed therein, a jet nozzle, a chamber adjacent said jet nozzle, a splitter having an upstream edge with a lateral width, said upstream edge disposed substantially perpendicular to the direction of flow through said nozzle and defining a portion of a downstream wall of said chamber opposite said nozzle, first and second diffuser legs, said diffuser legs diverging laterally from one another, each said diffuser leg including an upper end and an outlet passage, each said upper end being disposed laterally adjacent said upstream edge of said splitter, said upper ends being disposed on opposite sides of said splitter from one another, each said diffuser leg running continuously between its respective upper end and its respective outlet passage and having no other fluid connection;

(b) flowing a fluid through said inlet passage of said fluidic oscillator at a first flow rate for a period of time sufficient to produce a steady oscillation of the primary flow between said diffuser legs at a first frequency;

(c) changing the flow rate at which said fluid flows through said fluidic oscillator until said steady oscillation at said first frequency stops, whereby a overpressure pulse is produced in said fluid;

(d) defining the flow rate at which said steady oscillation at said first frequency stopped as a second flow rate;

(e) flowing said fluid through said fluidic oscillator at said second flow rate for a period of time sufficient to produce a steady oscillation at a second frequency;

(f) re-defining said second flow rate as a new first flow rate and re-defining said second frequency as a new first frequency; and (g) repeating steps (b)–(f) sequentially producing overpressure pulses in the environment each time said steady oscillation at said first frequency stops.

4. A fluidic oscillator, comprising:

a body forming a flow path having top, bottom, and lateral walls including an inlet passage, a jet nozzle, a chamber adjacent said jet nozzle, and a pair of laterally diverging diffuser legs, each said diffuser leg extending continuously between an upper end fluidly connected to said chamber and an outlet port and having no other fluid connection;

a splitter being disposed between said diffuser legs and having an upstream edge with a lateral width, said upstream edge disposed substantially perpendicular to the direction of flow through said nozzle and defining a portion of a downstream wall of said chamber opposite said nozzle; and a turbulent flow generator being disposed on one of said top wall and said bottom wall of said flow path at a location up stream of said jet nozzle and extending into said flow path.

5. The fluidic oscillator of claim 4 wherein the turbulent flow generator comprises a bump step formed on one of said top wall and said bottom wall of said flow path, said bump step constituting a transition between a wall of said inlet passage and a wall of said jet nozzle where said wall of said jet nozzle does not lie along a line constituting an extension of said wall of said inlet passage, a surface of said bump step forming an angle with respect to said line constituting an extension of said wall of said inlet passage.

6. The fluidic oscillator of claim 5 wherein said surface of said bump step forms an angle between about 35° and 90° with respect to said line constituting an extension of said wall of said inlet passage.

7. The fluidic oscillator of claim 6 wherein the surface of said bump step forms an angle between about 45° and 90° with respect to said line constituting an extension of said wall of said inlet passage.

8. The fluidic oscillator of claim 4 wherein the turbulent flow generator includes a replaceable member.

9. The fluidic oscillator of claim 4 wherein the turbulent flow generator comprises a pin extending into said flow path from one of said top wall and said bottom wall.

10. The fluidic oscillator of claim 9 wherein said pin comprising said turbulent flow generator has a square cross-section.

11. The fluidic oscillator of claim 9 wherein said pin comprising said turbulent flow generator has a triangular cross-section.

12. The fluidic oscillator of claim 4 wherein the turbulent flow generator comprises surface discontinuities formed on one of said top wall and said bottom wall.

13. The fluidic oscillator of claim 4 wherein the turbulent flow generator is reconfigurable within the body of the fluidic oscillator to change oscillating conditions.

14. The fluidic oscillator of claim 13 wherein said body further defines a plurality of apertures formed in one of said top wall and said bottom wall, and said turbulent flow generator comprises at least one pin which is mountable in more than one of said plurality of apertures and which is mounted in one of said apertures such that a portion of said pin extends into said flow path.

15. The fluidic oscillator of claim 4 wherein the turbulent flow generator is formed by the combination of a bump step and a pin extending into the flow path.

16. The fluidic oscillator of claim 3 further comprising a supplemental vortex generator disposed in each said diffuser leg, each said supplemental vortex generator extending into the flow path.

17. A fluidic oscillator comprising a body forming fluid passages including an inlet passage having a turbulent flow generator, a jet nozzle downstream of said inlet passage, a chamber downstream of said nozzle, a flow splitter having a leading edge longitudinally aligned with said nozzle and forming the downstream wall of said chamber, a first and second diffuser passage connected to opposite downstream sides of said chamber, and a pair of outlet ports, each outlet port being in communication with one of said first and second diffuser passages, said turbulent flow generator producing vortices in a fluid passing through said inlet passage and into said nozzle, said vortices being entrained in the fluid flowing down one of said first and second diffuser passages which is not blocked by a blocking vortex and increasing the friction pressure of the fluid moving through said diffuser passage until said pressure overcomes the blocking pressure exerted by the blocking vortex, thereby causing the flow of fluid to switch into another of said first and second diffuser passages.

18. The fluidic oscillator of claim 16, wherein at least one of said supplemental vortex generators comprises a bump step formed on a wall of said diffuser leg.

19. A fluidic oscillator, comprising:

a body forming an inlet passage, a jet nozzle, a chamber adjacent said jet nozzle, a splitter having an upstream edge with a lateral widthm, said upstream edge disposed substantially perpendicular to the direction of flow through said nozzle and defining a portion of a downstream wall of said chamber opposite said nozzle, first and second diffuser legs, said diffuser legs diverging laterally from one another, each said diffuser leg including an upper end and an outlet passage, each said upper end being disposed laterally adjacent said upstream edge of said splitter, said upper ends being disposed on opposite sides of said splitter from one another, each said diffuser leg running continuously between its respective upper end and its respective outlet passage and having no other fluid connection;

whereby fluid flowing sequentially downstream through the inlet passage, jet nozzle and chamber flows alternately through said first diffuser leg and said second diffuser leg.

20. The fluidic oscillator of claim 19 wherein the jet nozzle has a lateral width dimension and an exit, the ratio of the lateral width of the jet nozzle to the distance from the exit of the jet nozzle to the upstream edge of the splitter being in the range from about 1 to about 6.

21. A fluidic oscillator comprising:

a body forming fluid passages including an inlet passage having a turbulent flow generator, a jet nozzle downstream of said inlet passage, a chamber downstream of said nozzle, and a pair of laterally diverging diffuser passages downstream of said chamber, each said diffuser passage extending continuously between an upstream end and an outlet port and having no other fluid connection;

a flow splitter laterally disposed between said diffuser passages and having a leading edge laterally aligned with said nozzle and forming a downstream wall of said chambers;

said turbulent flow generator being disposed on one of said top wall and said bottom wall of said inlet passage and extending into said inlet passage;

whereby vortices are produced in a fluid passing through said inlet passage and into said nozzle, said vortices being entrained in the fluid flowing down one of said diffuser passages which is not blocked by a blocking vortex and increasing the friction pressure of the fluid moving through said diffuser passage until said pressure overcomes the blocking pressure exerted by the blocking vortex, thereby causing the flow of fluid to switch into another of said diffuser passages.

* * * * *